US010470543B2

(12) United States Patent
Kogelnik

(10) Patent No.: US 10,470,543 B2
(45) Date of Patent: Nov. 12, 2019

(54) HANDLE CONSTRUCTION FOR AN ITEM OF LUGGAGE AND ITEM OF LUGGAGE COMPRISING SUCH A HANDLE CONSTRUCTION

(71) Applicant: VOCIER GMBH, Wiener Neustadt (AT)

(72) Inventor: Michael Kogelnik, Vienna (AT)

(73) Assignee: VOCIER GMBH, Wiener Neustadt (AT)

( * ) Notice: Subject to any disclaimer, the term of this patent is extended or adjusted under 35 U.S.C. 154(b) by 92 days.

(21) Appl. No.: 15/670,415

(22) Filed: Aug. 7, 2017

(65) Prior Publication Data

US 2017/0332760 A1 Nov. 23, 2017

Related U.S. Application Data

(62) Division of application No. 14/340,909, filed on Jul. 25, 2014, now abandoned.

(30) Foreign Application Priority Data

Jul. 26, 2013 (EP) ..... 13178188

(51) Int. Cl.
*A45C 13/28* (2006.01)
*A45C 13/26* (2006.01)
*A45C 5/03* (2006.01)

(52) U.S. Cl.
CPC ..... *A45C 13/28* (2013.01); *A45C 5/03* (2013.01); *A45C 13/262* (2013.01); *A45C 13/26* (2013.01); *Y10T 16/4554* (2015.01)

(58) Field of Classification Search
CPC ..... A45C 13/28; A45C 5/03; A45C 13/262; A45C 13/26; Y10T 16/4554
See application file for complete search history.

(56) References Cited

U.S. PATENT DOCUMENTS 1,455,452 A * 5/1923 Semenick ..... A45C 3/00 190/110
2,547,265 A 4/1951 Hilgeman
(Continued)

FOREIGN PATENT DOCUMENTS

CN 2 616 104 Y 5/2004
DE 20 2010 016 179 U1 3/2011
(Continued)

OTHER PUBLICATIONS

European Search Report dated Jan. 30, 2014 in European Application No. 13178188.2 with English translation of relevant parts.
(Continued)

*Primary Examiner* — Tri M Mai
(74) *Attorney, Agent, or Firm* — Collard & Roe, P.C.

(57) ABSTRACT

A handle construction for an item of luggage, in particular a suitcase, and an item of luggage, in particular a suitcase, including such a handle construction, has a hand grip and at least one rod or the like connected to the hand grip, the rod being able to be transferred between a stowed position and a position of use. A pouch with an opening is connected to at least one rod or the like or the hand grip. To permit rapid and simple storage and removal of objects, the pouch is integrated in the handle construction and together with the hand grip is able to be transferred between the stowed position and the position of use.

5 Claims, 6 Drawing Sheets

(56) References Cited

U.S. PATENT DOCUMENTS

| | | | | |
|---|---|---|---|---|
| 2,723,696 | A * | 11/1955 | Kase | A45C 13/08 150/104 |
| 3,886,966 | A | 6/1975 | Yabuta et al. | |
| 4,194,627 | A | 3/1980 | Christensen | |
| 5,244,175 | A * | 9/1993 | Frankel | A47G 23/0225 211/113 |
| 5,269,157 | A | 12/1993 | Ciminelli et al. | |
| 5,354,131 | A | 10/1994 | Mogil | |
| 5,642,749 | A | 7/1997 | Perryman | |
| 5,671,832 | A | 9/1997 | London et al. | |
| 5,829,559 | A | 11/1998 | Nordstrom et al. | |
| 6,026,833 | A | 2/2000 | Conte | |
| 7,168,537 | B2 | 1/2007 | Bellini | |
| D540,030 | S | 4/2007 | Schnackenberg | |
| 7,510,157 | B2 | 3/2009 | Oliver | |
| 8,307,966 | B2 * | 11/2012 | Cummins | A45F 5/00 190/102 |
| 9,027,722 | B1 | 5/2015 | Parker | |
| 2005/0145458 | A1 | 7/2005 | Cohen | |
| 2006/0022006 | A1 | 2/2006 | Cruise | |
| 2006/0037825 | A1 | 2/2006 | Dayton et al. | |
| 2007/0295570 | A1 | 12/2007 | Campbell et al. | |
| 2008/0196988 | A1 | 8/2008 | Tong | |
| 2011/0132708 | A1 | 6/2011 | Deline et al. | |
| 2013/0126686 | A1 | 5/2013 | Ballou | |
| 2013/0313058 | A1 | 11/2013 | Yoshida | |
| 2014/0060989 | A1 | 3/2014 | Johnson | |

FOREIGN PATENT DOCUMENTS

| | | | |
|---|---|---|---|
| EP | 2 676 566 | A1 | 12/2013 |
| JP | 3099417 | U | 4/2004 |
| JP | 3160590 | U | 8/2010 |
| JP | 3167647 | U | 4/2011 |
| JP | 2012-135690 | A | 7/2012 |
| TW | 201 236 599 | A | 9/2012 |

OTHER PUBLICATIONS

Japanese Office Action in JP 2014-152895, dated Jul. 28, 2015, with English translation.

* cited by examiner

HANDLE CONSTRUCTION FOR AN ITEM OF LUGGAGE AND ITEM OF LUGGAGE COMPRISING SUCH A HANDLE CONSTRUCTION

CROSS REFERENCE TO RELATED APPLICATIONS

This application is a divisional of and Applicant claims priority under 35 U.S.C. §§ 120 and 121 of U.S. application Ser. No. 14/340,909 filed on Jul. 25, 2014, which claims priority under 35 U.S.C. § 119 from European Patent Application No. 13178188.2 filed Jul. 26, 2013, the disclosures of each of which are hereby incorporated by reference. A certified copy of priority European Patent Application No. 13178188.2 is contained in parent U.S. application Ser. No. 14/340,909.

BACKGROUND OF THE INVENTION

1. Field of the Invention

The invention relates to a handle construction for an item of luggage, in particular a suitcase, having a hand grip and at least one rod or the like connected to the hand grip, said rod being able to be transferred between a stowed position and a position of use, and having a pouch with an opening which is connected to at least one rod or the like or the hand grip.

The invention further relates to an item of luggage, in particular a suitcase, with such a handle construction.

2. Description of the Related Art

Items of luggage, in particular suitcases, frequently have two or even four wheels and a handle construction which is generally telescopic in order to be able to transport the item of luggage comfortably in the slightly tilted or upright state.

In particular, in the case of hard shell suitcases, there is frequently no possibility of rapidly stowing small objects, such as for example boarding passes or the like. In such hard shell suitcases, for stowing and/or removing objects the suitcase generally has to be completely opened which, in particular in restricted conditions, such as for example on board a passenger aircraft, is extremely troublesome.

To a certain degree at least one additional compartment attached to the outside of the item of luggage provides assistance here, but this is undesirable, in particular in the case of hard shell suitcases, as it interferes with the smooth surface and may be a hindrance when handling the item of luggage. Additionally, the stability and strength of the protective shell may be impaired by such a construction. In items of luggage made of fabric, pouches are generally integrated in the outer region but said pouches are often only able to be reached by awkward stooping or kneeling, due to the low height of suitcases.

JP 2012-135690 A discloses a construction in which a small item of luggage may be fastened to the extension rods of a suitcase and thus may be transported together with the large item of luggage. The small item of luggage is simply placed on the upper region of the suitcase and secured against falling down there by a loop-like connection to the rods. In the retracted position of the handle construction, however, the small item of luggage is not able to be fixed.

US 2011/0132708 A1, US 2006/0022006 A1 and CN 2 616 104 Y disclose, for example, handle constructions and/or items of luggage of the prior art, the pouch attached to the handle construction not being able to be transferred together with the handle construction into the stowed position and having to be removed or at least emptied before retracting the handle construction into the stowed position.

An item of luggage is disclosed in DE 20 2010 016 179 U1 which is also able to be used as a seat, an element being arranged on the handle construction, said element being able to be used as a backrest when seated. Said element is able to be provided with straps and used as a rucksack. In this case, however, the remaining part of the item of luggage is not able to be used, as the hand grip for moving the item of luggage is integrated in the rucksack.

SUMMARY OF THE INVENTION

The object of the present invention is to provide an aforementioned handle construction and an item of luggage with such a handle construction which permits the possibility of storing different objects, such as keys, credit cards, flight tickets, passports, mobile telephones, writing instruments, headphones, cameras, music players, books, maps or the like and permits the carrier of the item of luggage to stow such objects and/or to remove such objects from the item of luggage rapidly and easily. Drawbacks with the known constructions are intended to be avoided or at least reduced.

The object according to the invention is achieved by an aforementioned handle construction in which the pouch is integrated in the handle construction and together with the hand grip is able to be transferred between the stowed position and the position of use. By such an extension of the conventional handle construction, the carrier of the item of luggage is able to stow various small objects in the integrated pouch in a rapid and simple manner, without the opening and closing of the item of luggage itself being required. The pouch integrated in the handle construction is located in the position of use at an optimal handle height and also permits handling without stooping or kneeling. A pouch integrated in such a manner in the handle construction is able to be produced relatively easily and cost-effectively in terms of construction.

Conventionally, a handle construction is implemented by at least one rod or the like connected to the hand grip, said rod being displaceable between the stowed position and the position of use. In this case, the at least one rod or plate of the handle construction may be arranged on the outside of the item of luggage or may extend concealed in the interior and may be displaced between the stowed position in which at most the hand grip protrudes from the item of luggage but ideally is also concealed, and the position of use in which the handle construction constitutes an extension of the item of luggage in order to permit a more comfortable transportation of the item of luggage. When displaced between the stowed position and the position of use, the pouch integrated in the handle construction according to the invention is displaced therewith. Thus in the position of use the pouch is accessible and in the stowed position the pouch is concealed or also accessible depending on the design of the handle construction.

The at least one rod or the like of the handle construction may be configured to be telescopic. This is advantageous, in particular with small items of luggage, such as for example items of luggage of hand luggage size, since as a result a greater length of the handle construction may be achieved in the position of use which also permits a more comfortable transportation of the item of luggage without physical effort.

As an alternative to the above variant with at least one rod, the handle construction may also have a plate connected to the hand grip, said plate being able to be transferred between the stowed position and the position of use. In this case, the plate may be both displaced and pivoted between the stowed position and the position of use. In the construction in the form of a plate, the pouch according to the invention may be integrated directly into the plate or even fastened thereto, if required.

According to a further feature of the invention, the pouch is releasably connected to the at least one rod or the like or to the hand grip. The releasable connection of the pouch to the handle construction permits a simple replacement of the pouch in the event of damage or soiling and also removal of the pouch when said pouch is not in use. The pouch removed from the handle construction may also fulfil a separate function and be used as a small handbag or the like.

In this case, it is advantageous if connecting elements are provided on the handle construction for the releasable connection to the pouch. Such connecting elements may, for example, be formed by loops, magnetic closures, press fasteners, rails or the like. Depending on the size and arrangement of the pouch, for example, the hand grip may be provided integrally with rails to which the pouch may be fastened.

According to a further feature of the invention, the pouch may be configured to be of variable size. The alteration to the size of the pouch may be implemented in a manner similar to the known solutions in suitcases, bags, rucksacks or handbags, for example via zip closures and corresponding folding mechanisms. By enlarging the stowage space of the pouch, more objects may be arranged in the pouch, although the transfer of the handle construction into the stowed position may then be hindered.

The pouch or a connecting element for the pouch or a holding device for the pouch may be produced integrally with the at least one rod or the like or the hand grip. By such an integral production of the pouch, the connecting element or the holding device, the production costs may be reduced and the number of individual parts decreased.

Preferably, a device for blocking at least in the stowed position is provided on the handle construction. As a result, the handle construction may be prevented from being inadvertently released at least from the stowed position, which would make it easier to damage the handle construction when transporting the item of luggage. Additionally, the blocking device may also be configured for blocking in the position of use, in order to be able to prevent an inadvertent transfer of the handle construction from the position of use into the stowed position.

The pouch may be formed from textile material, such as for example different fabrics, but also from substantially solid material, in particular plastics material. The variant of the pouch made from solid material relative to the variant made from textile material differs in that the volume of the pouch is substantially constant and, as a result, may not be substantially altered. It is advantageous or even necessary to conceal the pouch which is integrated in the handle construction in the item of luggage in the stowed position, however, as otherwise it may lead to a blockage of the overfilled pouch when displacing the handle construction into the stowed position. The variant made of fabric has the advantage that a more flexible loading of the pouch is possible and that potential weight may be saved. This is advantageous, particularly in a construction of the item of luggage in which the pouch does not have to be recessed into an opening. In particular, in the construction using a flexible fabric it is advantageous if the fabric is supported by a visible or invisible holding device made of solid material which may be designed integrally with the hand grip.

The opening of the pouch is preferably configured to be able to be closed, which may be implemented by conventional methods, such as for example zip closures, magnetic closures, press fasteners, hook and loop closures or the like.

It is also advantageous if sub-dividers are arranged in the pouch in order to permit separate storage of the small items and an ordered arrangement.

Moreover, a device for locking the opening of the pouch may be provided in order to prevent unauthorised opening of the pouch when temporarily abandoning the item of luggage. Such locking devices may be formed by padlocks, combination locks or even electronic devices.

The pouch arranged in the handle construction may contain a logo of the manufacturer of the handle construction of the item of luggage or even individual logos.

It is also advantageous if at least one hook is provided on the handle construction. An item of clothing or a small carrier bag may be arranged on such a hook, and the waiting time may be eased, in particular of passengers in transfer areas. The at least one hook may be arranged at any point of the handle construction with which it does not interfere and also is not able to result in injury. To prevent injury, in particular concealed hooks which do not protrude from the outer surface of the handle construction are to be preferred.

According to one embodiment, the at least one hook may be arranged on the hand grip. For example, during waiting times a jacket may be fastened to these hooks by means of the conventionally provided loop and securely protected from slipping off from the handle construction.

If the at least one hook is configured to be removable it may be easily exchanged after potential damage or even removed in the case of non-use.

The object according to the invention is also achieved by an aforementioned item of luggage having a handle construction according to the above description. The item of luggage preferably has at least two wheels, rollers or the like, variants with four or more wheels, rollers or the like also being conceivable.

Advantageously, a recess is provided in the item of luggage for at least partially receiving the pouch and the hand grip in the stowed position of the handle construction. The handle construction may be arranged together with the integrated pouch on the outside of the item of luggage. If the handle construction together with the pouch integrated therein is recessed in the stowed position into the receiver provided therefor, the item of luggage in the stowed position of the handle construction is not larger than an item of luggage without a handle construction, which is why approval, for example, as hand luggage is permitted. Moreover, by being stowed, damage to the handle construction and the pouch arranged therein may be substantially prevented.

The hand grip or the pouch may be configured to be accessible in the stowed position of the handle construction. As a result, the carrier of the item of luggage may operate the handle construction and transfer said handle construction into the position of use very rapidly and easily.

BRIEF DESCRIPTION OF THE DRAWINGS

The invention is described in more detail with reference to the accompanying drawings, in which.

DETAILED DESCRIPTION OF PREFERRED EMBODIMENTS

Figures 1A, 1B, 1C:
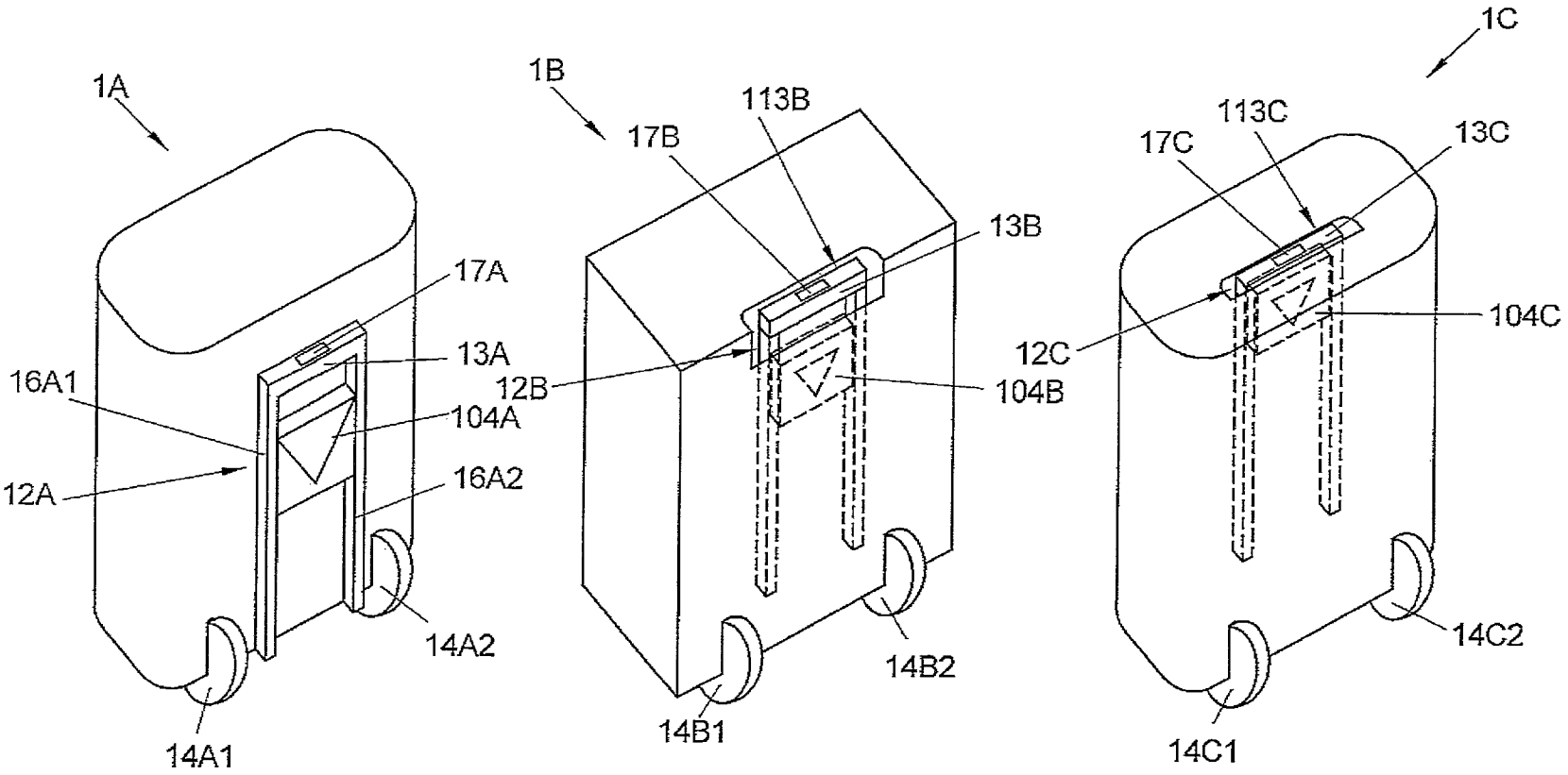
FIGS. 1A to 1C show perspective views of different embodiments of an item of luggage with a handle construction in the stowed position.

FIG. 1A shows a perspective view of an item of luggage 1A in the form of a suitcase with a handle construction 2A configured according to the invention. In the exemplary embodiment of the item of luggage 1A shown, the handle construction 2A is arranged on the outside on one side of the item of luggage 1A and is located in the stowed position. The handle construction 2A is able to be transferred into a position of use in which the two rods 16A1, 16A2 of the handle construction 2A may be displaced. For easier transportation of the item of luggage 1A, two wheels 14A1, 14A2 are located on the lower face. An inadvertent transfer into the position of use may be prevented by means of a device 17A for blocking the handle construction 2A at least in the stowed position. In the position of use (not shown) the suitcase may be pulled along by the hand grip 13A at an oblique angle. In the arrangement of four steerable wheels, the item of luggage 1A may also be wheeled in an upright position. According to the invention, a pouch 104A with an opening is integrated in the handle construction 2A. In the example shown, the pouch 104A is located between the two rods 16A1, 16A2 of the handle construction 2A. The pouch 104A serves for storing small items, such as keys, credit cards, frequent flier tickets, flight tickets, train tickets, passports, mobile telephones, pens, headphones, music players, maps, itineraries or the like and permits rapid access to said small items without the item of luggage 1A having to be opened. The opening of the pouch 104A in the example shown is closed by a tab, so that the small items are not able to fall out of the pouch 104A.

FIG. 1B shows a further embodiment of a cuboidal item of luggage 1B, wherein the handle construction 2B is able to be partially recessed into a recess 113B in the item of luggage 1B. This embodiment includes a hand grip 13B, a device 17B for blocking the handle construction 2B, a pouch 104B, and two wheels 14B1 and 14B2.

In the variant according to FIG. 1C the recess 113C is formed by a slot-shaped opening in the item of luggage 1C in which the handle construction 12C together with the pouch 104C may be completely recessed in the stowed position. By actuating the blocking device 17C on the hand grip 13C of the handle construction 12C, the handle construction 12C may be transferred into the position of use in which the item of luggage 1C may be comfortably wheeled. In this position of use, the pouch 104C integrated in the handle construction 12C is also accessible.

Instead of transferring the handle construction 12A between the stowed position and the position of use, by displacing the rods 16A1, 16A2 it may also be possible to pivot, for example, a plate.

Figure 2B:
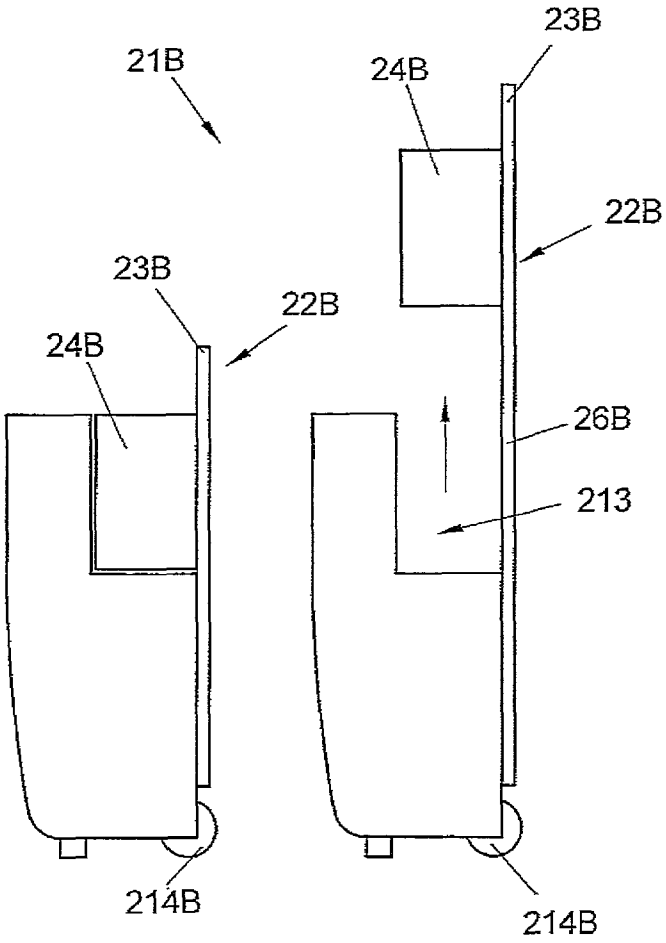
FIGS. 2A and 2B show two embodiments of an item of luggage with a handle construction, in each case in the stowed position and in the position of use in side view.
Figure 2A:
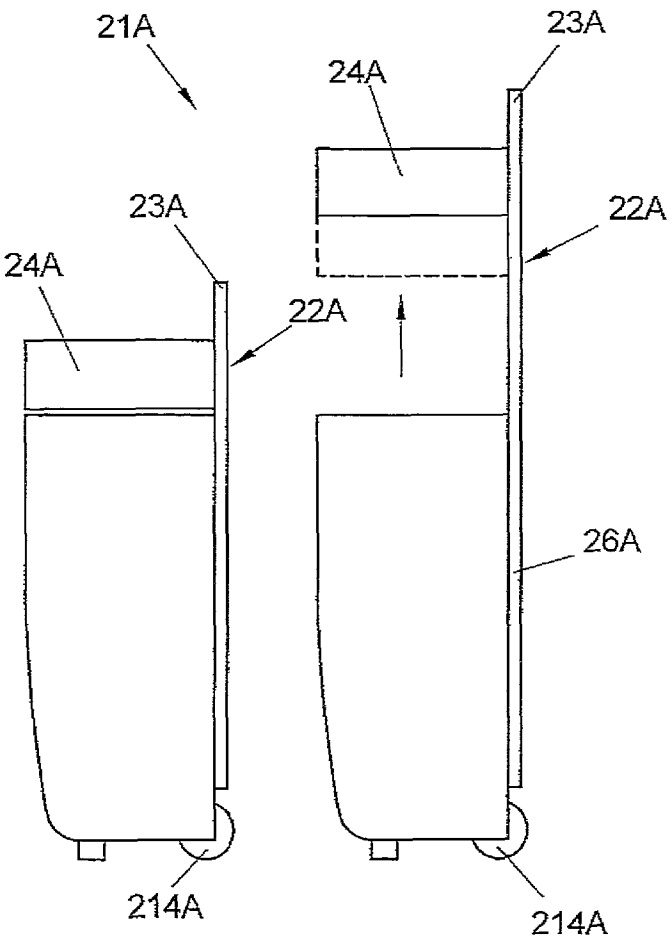

FIG. 2A shows a further schematic embodiment of an item of luggage 21A in which the pouch 24A integrated in the handle construction 22A partially extends the item of luggage 21A in the stowed position (left-hand side) and is displaced in the position of use (right-hand image) with the hand grip 23A. In this variant, the pouch 24A is of considerably larger design in comparison with the hand grip 23A. It may be designed to be sufficiently large that it officially constitutes a substantial proportion of the item of luggage 21A in the stowed position of the handle construction 22A. In this case, larger objects such as cameras, books, large wallets or other large objects may also be easily stowed in the pouch 24A. By corresponding structural embodiments, the size of the pouch 24A may be altered as indicated by the dashed line in the right-hand image. In such a state, more objects may be accommodated in the pouch 24A, although it is no longer possible to recess the pouch 24A in the stowed position of the handle construction. This embodiment also has wheels, one of which 214A is visible from this side view. One of the rods 26A is visible.

The variant according to FIG. 2B shows a recess 213 in the item of luggage 21B in which a correspondingly shaped pouch 24B of the handle construction 22B may be integrated in the stowed position (left-hand image). In the position of use (right-hand image) the pouch 24B is arranged so as to be easily accessible in the region of the hand grip 23B of the handle construction. This embodiment also has wheels, one of which 214B is visible from this side view. One of the rods 26B is visible.

The pouch 24B may be formed both from textile material and from substantially solid material, in particular plastics material. The opening of the pouch 24B may be closed by different known mechanisms.

Figure 3:
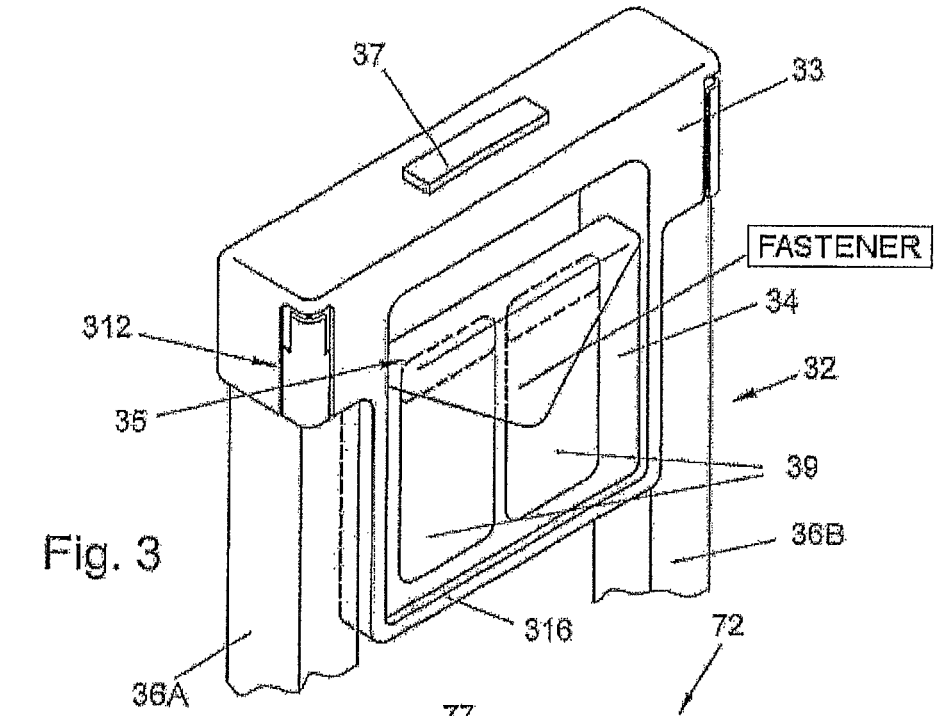
FIG. 3 shows a perspective view of a part of a handle construction for an item of luggage with an integrated pouch.

FIG. 3 shows an embodiment of a handle construction 32 according to the invention for an item of luggage, wherein the pouch 34 is arranged between the two rods 36A, 36B of the handle construction 32 in a frame-like holding device 316 below the hand grip 33. The frame of the pouch 34 may be formed by part of the hand grip 33 of the handle construction 32. The opening 35 of the pouch 34 is closed by a tab. Compartments 39 are preferably located inside the pouch 34 in order to permit an ordered arrangement of the small items. Moreover, it is advantageous if hooks 312 are arranged on the handle construction 32, in particular on the hand grip 33, which permit an item of clothing or carrier bag or the like to be suspended. In the exemplary embodiment shown, the hooks 312 are integrated in the hand grip 33, so that the risk of injury may be reduced and damage to the hook 312 prevented. This embodiment includes a device 37 for blocking the handle construction 32. A fastener, indicated schematically, is provided for closing the opening 35 of the pouch 34.

Figure 4:
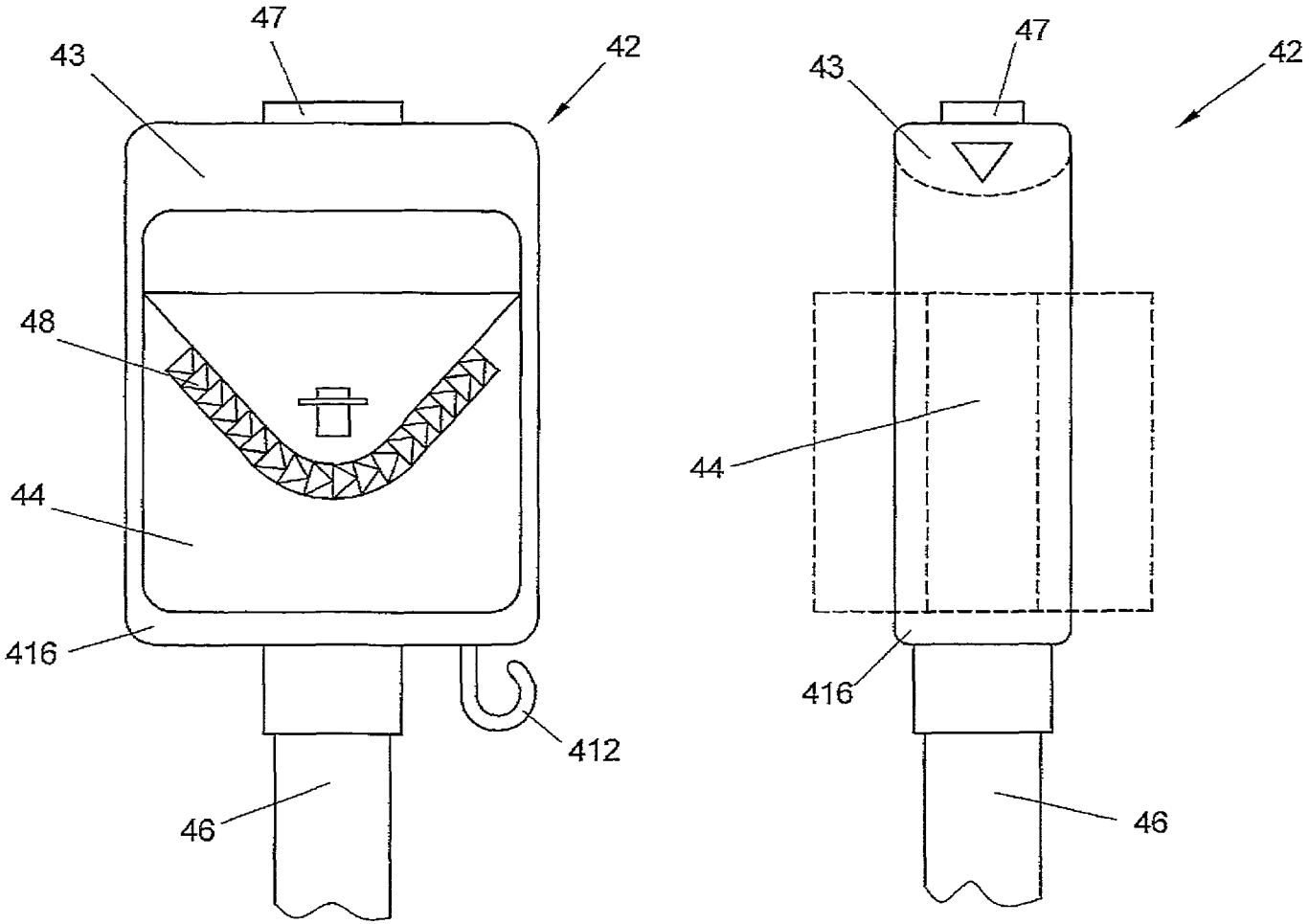
FIG. 4 shows two views of a part of a further embodiment of a handle construction for an item of luggage with an integrated pouch.

FIG. 4 shows a further embodiment of a handle construction 42 in which the handle construction 42 has only one rod 46, and the hand grip 43 is of frame-shaped configuration and/or has a frame-shaped holding device 416 for receiving the pouch 44 which, for example, is formed from textile material. The opening of the pouch 44 may be closed by a zip closure 48. A hook 412 is arranged on the lower face of the hand grip 43 of frame-shaped configuration, for suspending items of clothing or small shopping bags. Also in this case, the size of the pouch 44 may be altered by corresponding structural measures, as indicated by the dashed lines outside the holding device 416 of frame-shaped configuration. This embodiment includes a device 47 for blocking the handle construction 42.

Figure 5:
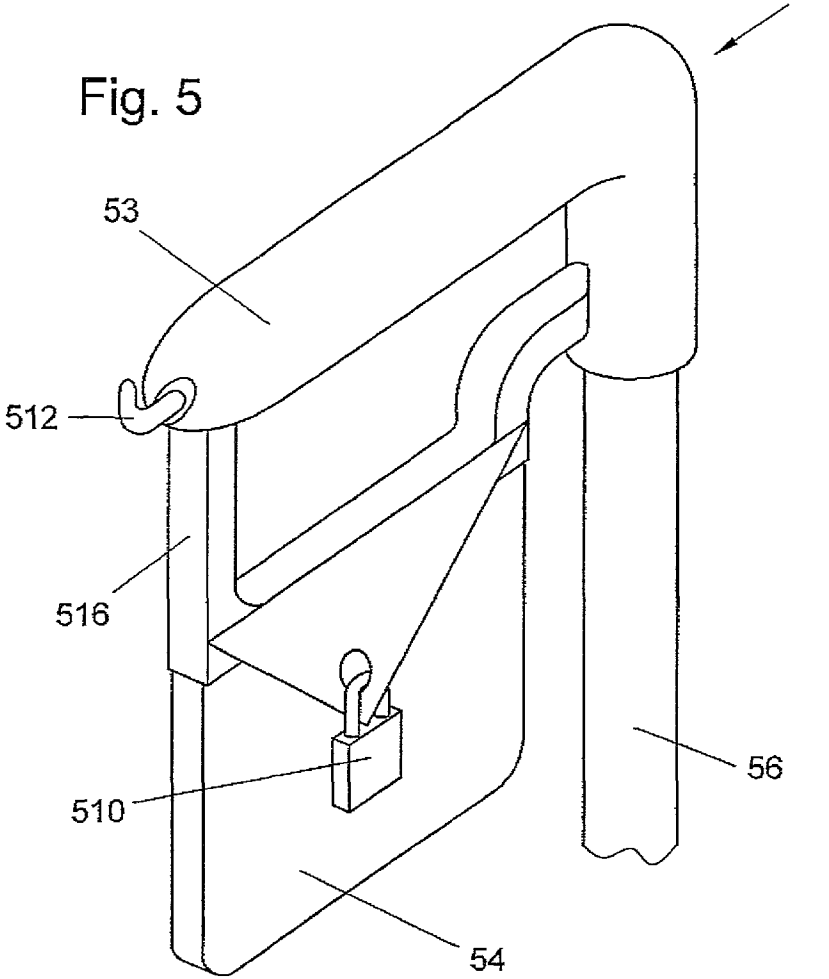

FIG. 5 shows an asymmetrical embodiment of a handle construction 52 with a rod 56 where the hand grip 53 only faces in one direction of the rod 56. The pouch 54 is arranged on the hand grip 53, in the exemplary embodiment shown, said pouch 54 being formed from solid material and being able to be arranged on a corresponding holding device 516. By means of a locking device 510, for example in the form of a padlock, the pouch 54 may be secured against unauthorised opening. A hook 512 may also be arranged once again on the hand grip 53, for suspending items of clothing or small shopping bags.

Figure 6:
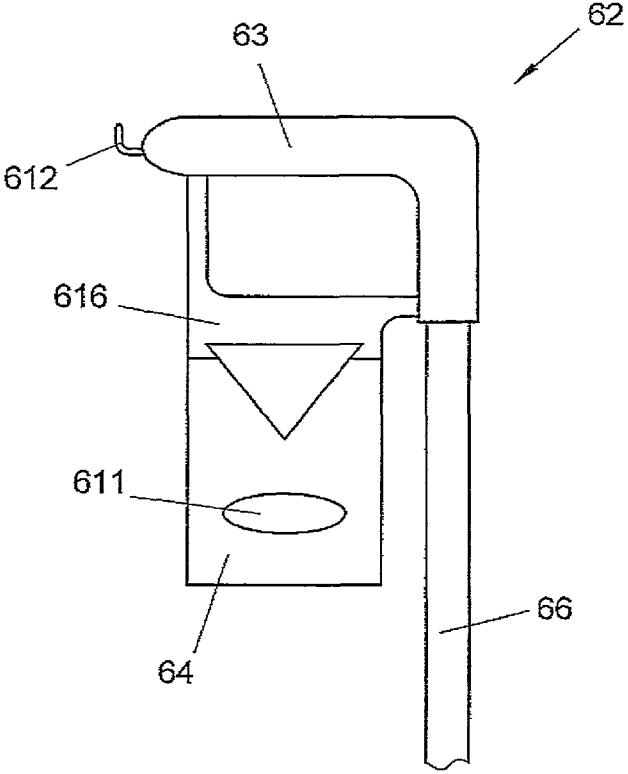

FIG. 6 shows a pouch 64 integrated in a handle construction 62, with a compartment 611 on the outside which is configured to be at least partially transparent, in order to permit the arrangement of a logo, a visitors card or the like in the compartment 611. This embodiment includes a holding device 616, a hook 612, a rod 66, and a hand grip 63.

Figure 7:
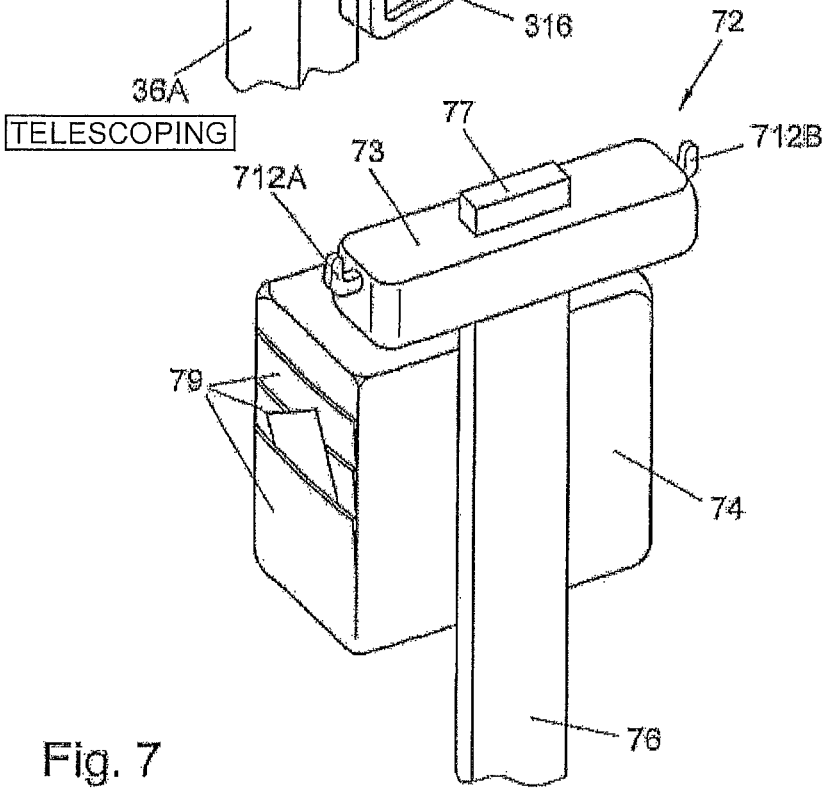
FIGS. 5 to 9 show perspective views of a part of further embodiments of a handle construction for an item of luggage with an integrated pouch.

FIG. 7 shows a further embodiment of a handle construction 72 according to the invention which consists of a rod 76 and a hand grip 73 with hooks 712A, 712B arranged on both sides, respectively. The pouch 74 is arranged on one side of the rod 76, and suspended via a holding device. Advantageously, the pouch 74 has compartments 79 on the outside for the arrangement of small items, such as for example credit cards or the like. This embodiment includes a device 77 for blocking the handle construction 72.

Figure 8:
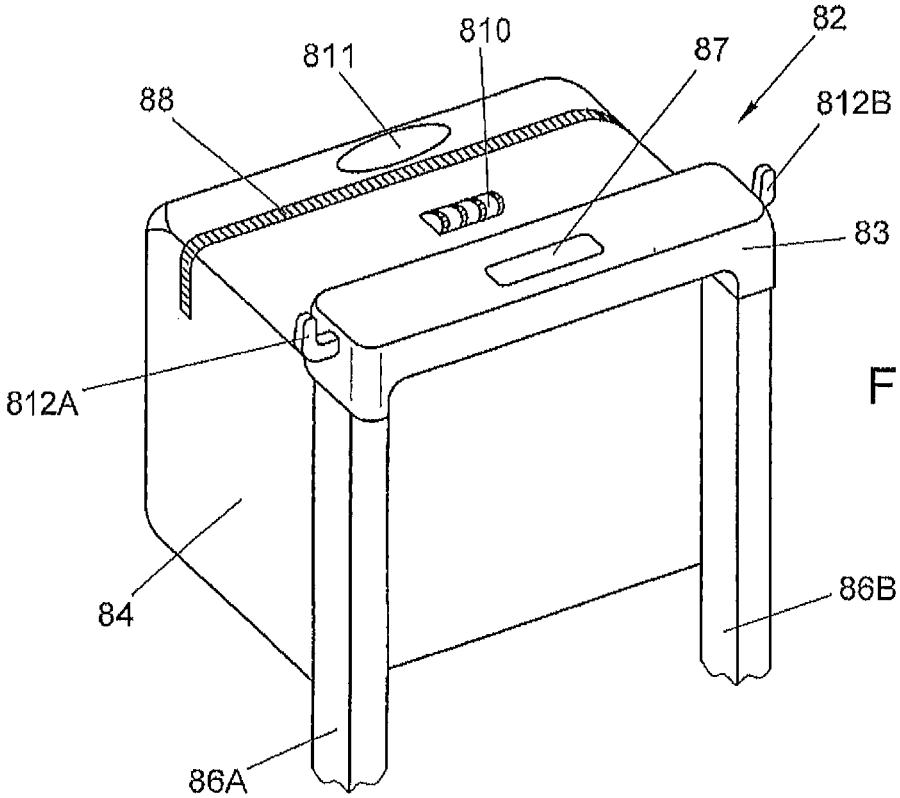

FIG. 8 shows a further embodiment of a handle construction 82 according to the invention for an item of luggage, wherein two rods 86A, 86B arranged in parallel are provided, said rods 86A, 86B leading into a hand grip 83 which has two hooks 812A, 812B. On the outside of the pouch in turn a pocket 811 made of at least partially transparent material may be provided for arranging a logo or the like or the logo or the like may be directly printed thereon. The opening of the pouch 84 may in turn be closeable by a zip closure 88. Additionally, a combination lock may be provided as a variant of a locking device 810. This embodiment includes a device 87 for blocking the handle construction 82.

Figure 9:
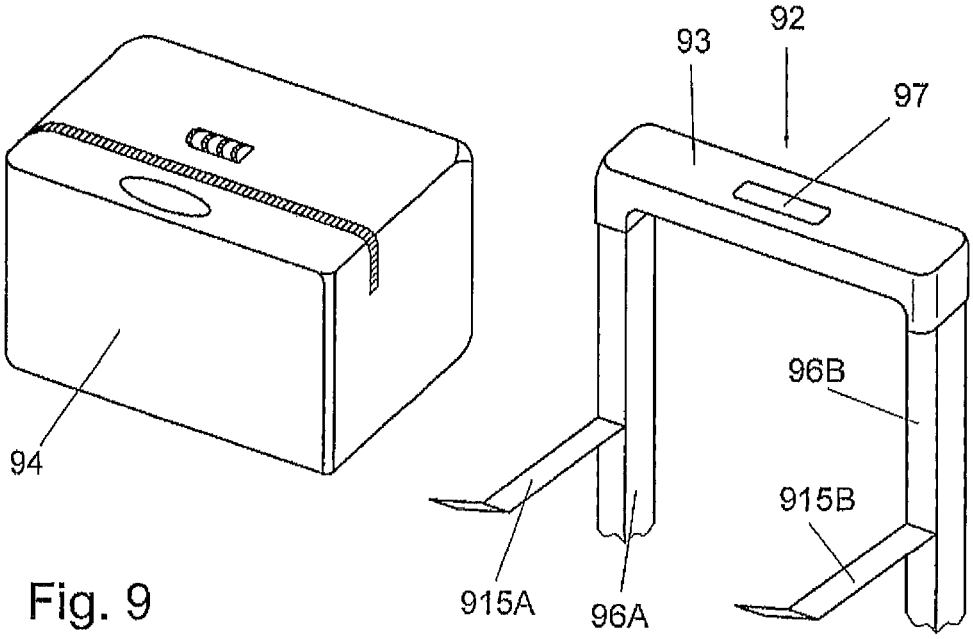

The pouch integrated in the handle construction may also be releasably connected to the handle construction, so that the pouch may be removed, for example, for the purpose of cleaning. FIG. 9 shows an example of such a releasable connection of the pouch 94 to the handle construction 92, wherein corresponding connecting elements 915A, 915B are provided. Variants for such connecting elements 915A, 915B are loops, magnetic closures, press fasteners, rails or the like. The hooks may also be releasably formed on the handle construction, in particular on the hand grip. Primarily, plastics or other lightweight stable materials such as carbon or aluminium are considered as materials for the hand grip. The pouch may also be formed from plastics material but also from leather or other textiles, carbon, aluminium or rubber. This embodiment includes a device 97 for blocking the handle construction 92.

The pouch is in any case accessible in the position of use of the handle construction, but may be concealed in the stowed position of the handle construction in the item of luggage and secured against access. Other variants in which the pouch may also be accessed in the stowed position are also conceivable.

What is claimed is:

1. An item of luggage having a handle construction, the handle construction having a hand grip, two telescopic rods connected to the hand grip, each telescopic rod being configured to be telescopic such that the handle construction is variable in length and thereby the hand grip being able to be transferred between a stowed position and a position of use, a pouch with an opening, wherein the pouch is disposed between the two telescopic rods and is connected to the hand grip, and a holding device for the pouch, wherein the holding device and the hand grip are made of one piece and are inseparable, wherein the pouch is integrated in the handle construction and is dimensioned to store small items, wherein the pouch and the hand grip are able to be transferred between the stowed position and the position of use, wherein the pouch is made from solid material, a volume of the pouch is substantially constant and as a result cannot be substantially altered, and wherein a recess is provided for at least partially receiving the pouch and the hand grip in the stowed position of the handle construction.

2. The item of luggage according to claim 1, wherein the opening of the pouch is able to be closed by a fastener.

3. The item of luggage according to claim 1, wherein at least one hook is provided.

4. The item of luggage according to claim 3, wherein the at least one hook is arranged on the hand grip.

5. The item of luggage according to claim 1, wherein the hand grip or the pouch are configured to be accessible in the stowed position of the handle construction.

* * * * *